US006145499A

United States Patent [19]

Tsuchishima

[11] Patent Number: 6,145,499

[45] **Date of Patent: *Nov. 14, 2000**

[54] WIRE SAW

[75] Inventor: Jiro Tsuchishima, Mitaka, Japan

[73] Assignee: Tokyo Seimitsu Co., Ltd., Tokyo, Japan

[ * ] Notice: This patent is subject to a terminal disclaimer.

[21] Appl. No.: 09/210,480

[22] Filed: Dec. 14, 1998

[30] Foreign Application Priority Data

Dec. 16, 1997 [JP] Japan ..... 9-346436

[51] Int. Cl.[7] ..... B28D 1/08

[52] U.S. Cl. ..... 125/21; 125/35

[58] Field of Search ..... 125/16.02, 35, 125/21; 451/364, 405, 403, 380, 387, 451, 452, 453, 454, 455, 456, 457; 83/651.1; D15/133

[56] References Cited

U.S. PATENT DOCUMENTS 4,655,191 4/1987 Wells et al. ..... 125/21
5,201,305 4/1993 Takeuchi ..... 125/21
5,616,065 4/1997 Egglhuber ..... 125/21
5,628,301 5/1997 Katamachi ..... 125/21
5,679,059 10/1997 Nishi et al. ..... 451/285
5,787,872 8/1998 Hauser ..... 125/16.02
5,878,737 3/1999 Hodsden ..... 125/16.02
5,890,481 4/1999 Bigelow ..... 125/21
5,904,136 5/1999 Nagatsuka et al. ..... 125/16.02

*Primary Examiner*—Derris H. Banks
*Attorney, Agent, or Firm*—Nixon Peabody LLP; David S. Safran

[57] ABSTRACT

A cover for covering a processing chamber, in which a plurality of grooved rollers of a wire saw is arranged, is composed of an outside cover and an inner cover. The outside cover covers the plurality of grooved rollers, and the inner cover covers an ingot. This prevents slurry and cutting chips from scattering to the outside of the wire saw while it is slicing the ingot. When the ingot is attached and detached, a winch opens the outside cover and a cylinder apparatus opens the inner cover to expose the processing chamber.

6 Claims, 5 Drawing Sheets

WIRE SAW

BACKGROUND OF THE INVENTION

1. Field of the Invention

The present invention relates generally to a wire saw, and more particularly to a wire saw which slices brittle material such as silicon, glass and ceramics into a number of wafers.

2. Description of Related Art

A wire saw, which slices a silicon ingot into a number of wafers, winds a wire on a plurality of grooved rollers to form wire rows between the grooved rollers, and presses the ingot against the running wire rows, thus slicing the ingot into a number of wafers in one slicing action.

In the wire saw, a processing chamber, in which the grooved rollers are arranged, is covered to prevent slurry and cutting chips from scattering to the outside of the wire saw. On completion of the slicing, the cover is opened and the sliced ingot is detached from a workpiece feed table. Then, a new ingot is attached to the workpiece feed table. An operator attaches and detaches the ingots manually.

The conventional wire saw, however, has a disadvantage in that the slurry and cutting chips scatter to the outside of the wire saw through a gap between the body of the wire saw and the cover, making the outside of the wire saw dirty. Moreover, when the cover is opened after slicing, the misty slurry in the processing chamber further scatters to the outside.

SUMMARY OF THE INVENTION

This invention has been developed in view of the above-described circumstances, and has as its object the provision of a wire saw which is able to prevent slurry and cutting chips from scattering to the outside of the wire saw during the slicing.

To achieve the above-mentioned object, the present invention is directed to a wire saw which winds a wire on a plurality of grooved rollers to form wire rows, runs the wire rows, and presses a workpiece against the running wire rows, thus slicing the workpiece into a number of wafers, the wire saw comprising: a cover for a processing chamber, in which the plurality of grooved rollers are arranged, the cover being composed of an outside cover and an inner cover; and opening and closing means for opening and closing the outside cover and the inner cover.

According to this invention, the cover for covering the processing chamber is composed of the outside cover and the inner cover, and it is therefore possible to prevent the slurry and cutting chips from scattering to the outside of the wire saw while it is slicing the workpiece. When the workpiece is attached and detached, the opening and closing means opens the outside cover and the inner cover to expose the processing chamber.

According to this invention, there is provided an exhaust means for exhausting the air in the processing chamber. The exhaust means is operated before the outside cover is opened, so that the misty slurry in the processing chamber can be exhausted with the air. After the slurry is exhausted, the outside cover and the inner cover are opened to attach and detach the workpiece. Consequently, the slurry and cutting chips do not scatter to the outside.

According to the present invention, there is provided a moving means for reciprocating a workpiece holder, which supports the workpiece in the wire saw, between the processing chamber and the outside of the wire saw. Since the moving means is operated in order to position the workpiece holder at the outside of the wire saw, it is easy to attach and detach the workpiece with respect to the workpiece holder. When the workpiece is attached to the workpiece holder, the driving means returns the workpiece holder to the processing chamber, and sets the workpiece at a slicing start position. Then, the outside cover and the inner cover are closed, and the workpiece holder feeds the workpiece to start slicing the workpiece.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
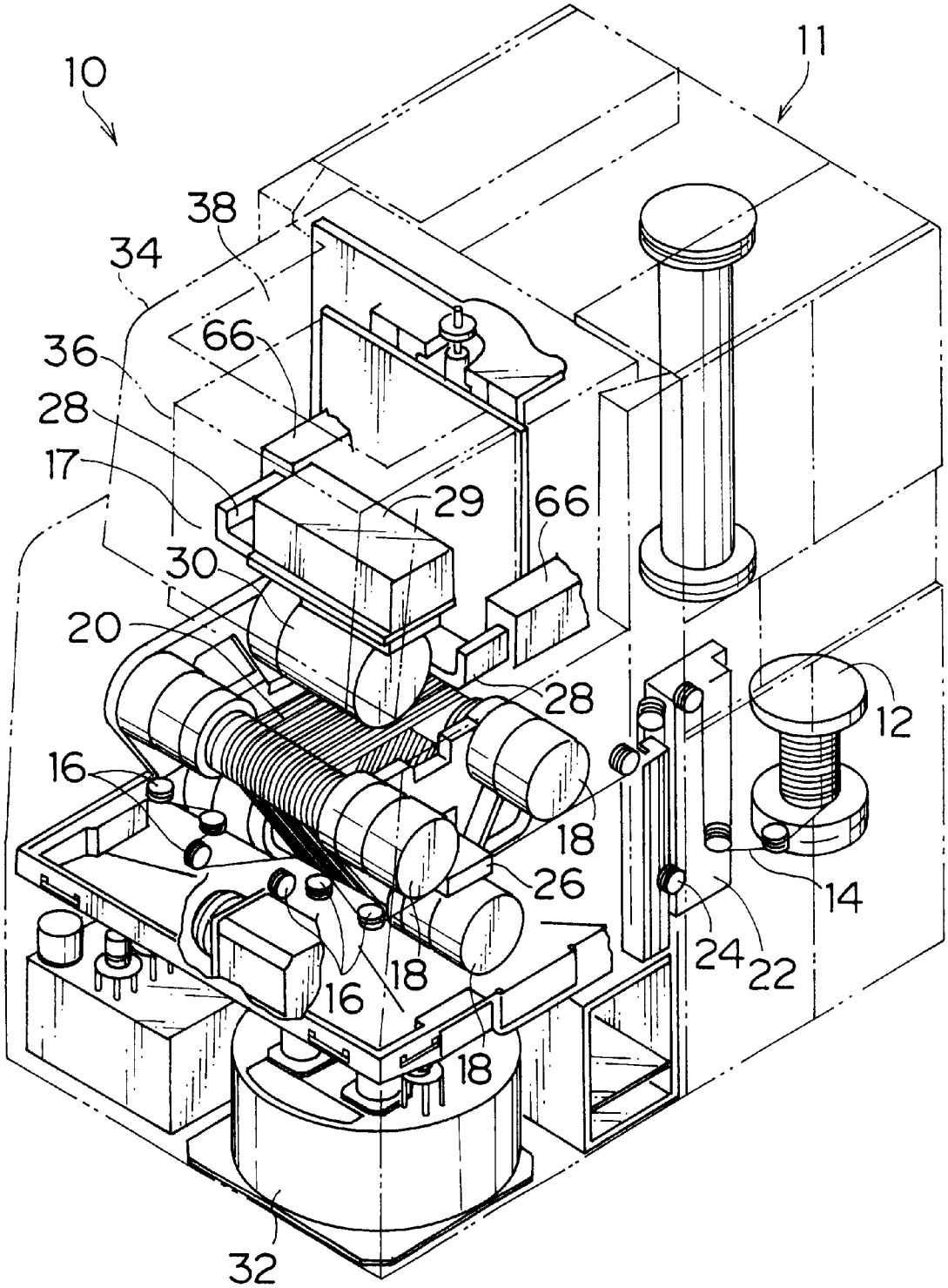
FIG. 1 is a perspective view illustrating the wire saw according to this invention.

FIG. 1 shows the structure of a wire saw including a partial cut away view according to an embodiment of the present invention.

In the wire saw 10, a wire reel 12 is arranged in a body 11. A wire 14 with a predetermined length is wound on the wire reel 12, and the wire 14 is fed to a processing chamber 17 through a wire running route formed by guide rollers 16. The wire 14 is wound on three grooved rollers 18 in the processing chamber 17 to form horizontal wire rows 20 between the upper two grooved rollers 18. The wire 14 is wound up by a wire reel (not illustrated) through another wire running route, which is formed symmetrically with respect to the above-mentioned wire running route across the wire rows 20.

A wire guide apparatus 22, a dancer roller 24, etc. are respectively arranged on the wire running routes formed at both ends of the processing chamber 17 (only one side is illustrated). The wire guide apparatus 22 guides the wire 14 from the wire reel 12 at a constant pitch. The dancer roller 24 applies a constant tension to the running wire 14, so that the wire 14 can be resistant to the slicing resistance.

Motors (not illustrated) connect to the pair of wire reels 12 and one of the three grooved rollers 18. Running these motors feeds the wire 14 at a high speed between the wire reels 12.

A workpiece feed table 29 is arranged above the grooved rollers 18, and the workpiece feed table 29 moves up and down vertically with respect to the wire rows 20. The ingot 30 is supported on the workpiece feed table 29.

The wire saw 10, which is constructed in the above-mentioned manner, slices the ingot 30 in a manner described below. First, the ingot 30 is placed on the workpiece feed table 29, and then, the workpiece feed table 29 is fed toward the wire rows 20. Then, the ingot 30 is pressed against the wire rows 20, which are running at a high speed. In this case, slurry is supplied to the wire rows 20 from a slurry tank 32 through a nozzle (not illustrated). The ingot 30 is sliced into a number of wafers at the same time by lapping operation of abrasive grains included in the slurry.

A cover, which covers the processing chamber 17 of the wire saw 10, is composed of an outside cover 34 and an inner cover 36 as indicated by long and short alternate lines in FIG. 1.

Figure 2:
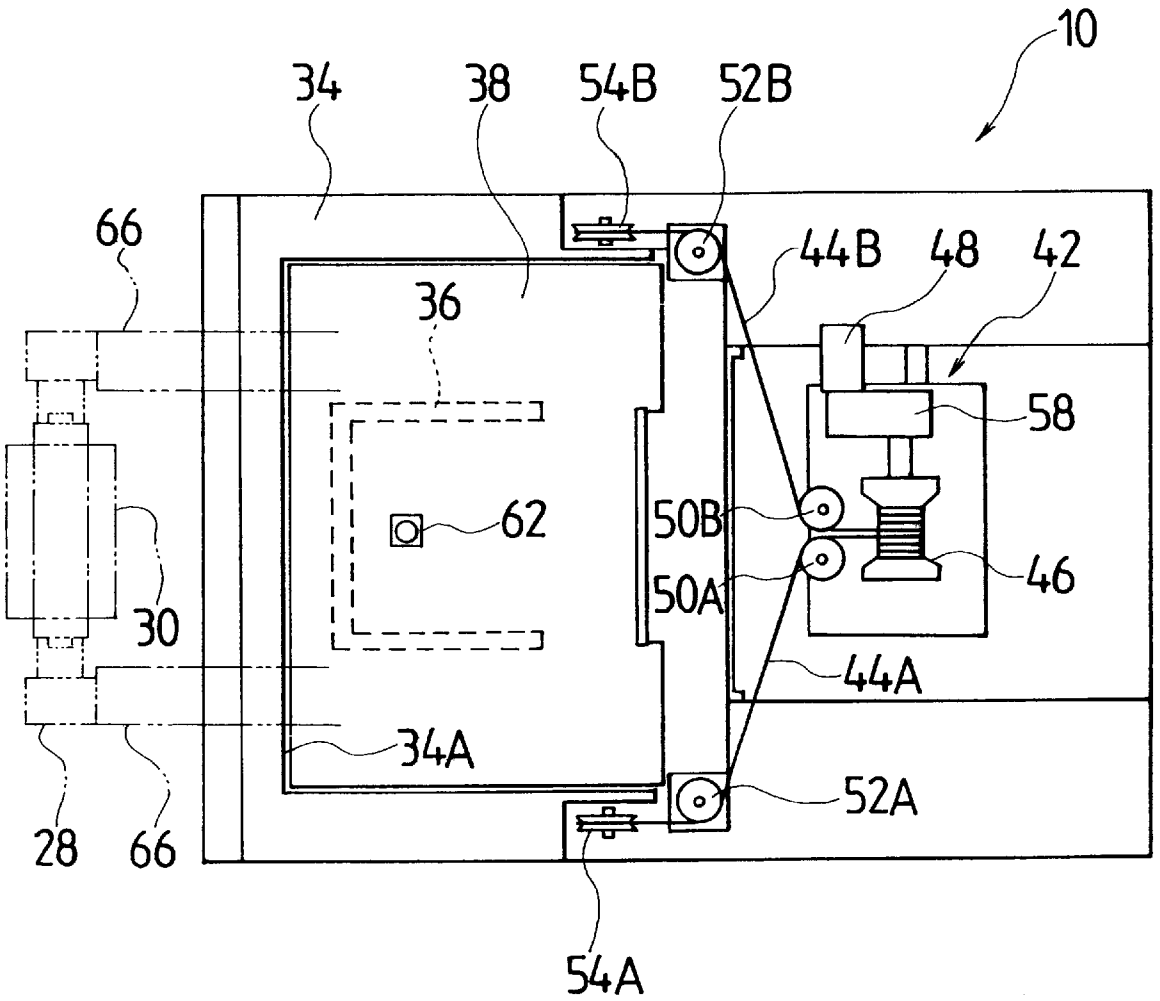
FIG. 2 is a top view of the wire saw in FIG. 1.

The outside cover 34 is substantially U-shaped as shown in FIGS. 1 and 2. A rectangular opening 34A is formed at the top of the outside cover 34, and a roof 38, which is fixed at the body 11, is arranged within the opening 34A. Packing (not illustrated) is attached to the outside cover 34 along the opening 34A. The outside cover 34 is attached to the roof 38 through the packing when the processing chamber 17 is closed in FIGS. 1 and 2. Thus, the upper part of the processing chamber 17 is tightly closed by the outside cover 34 and the roof 38.

Figure 3:
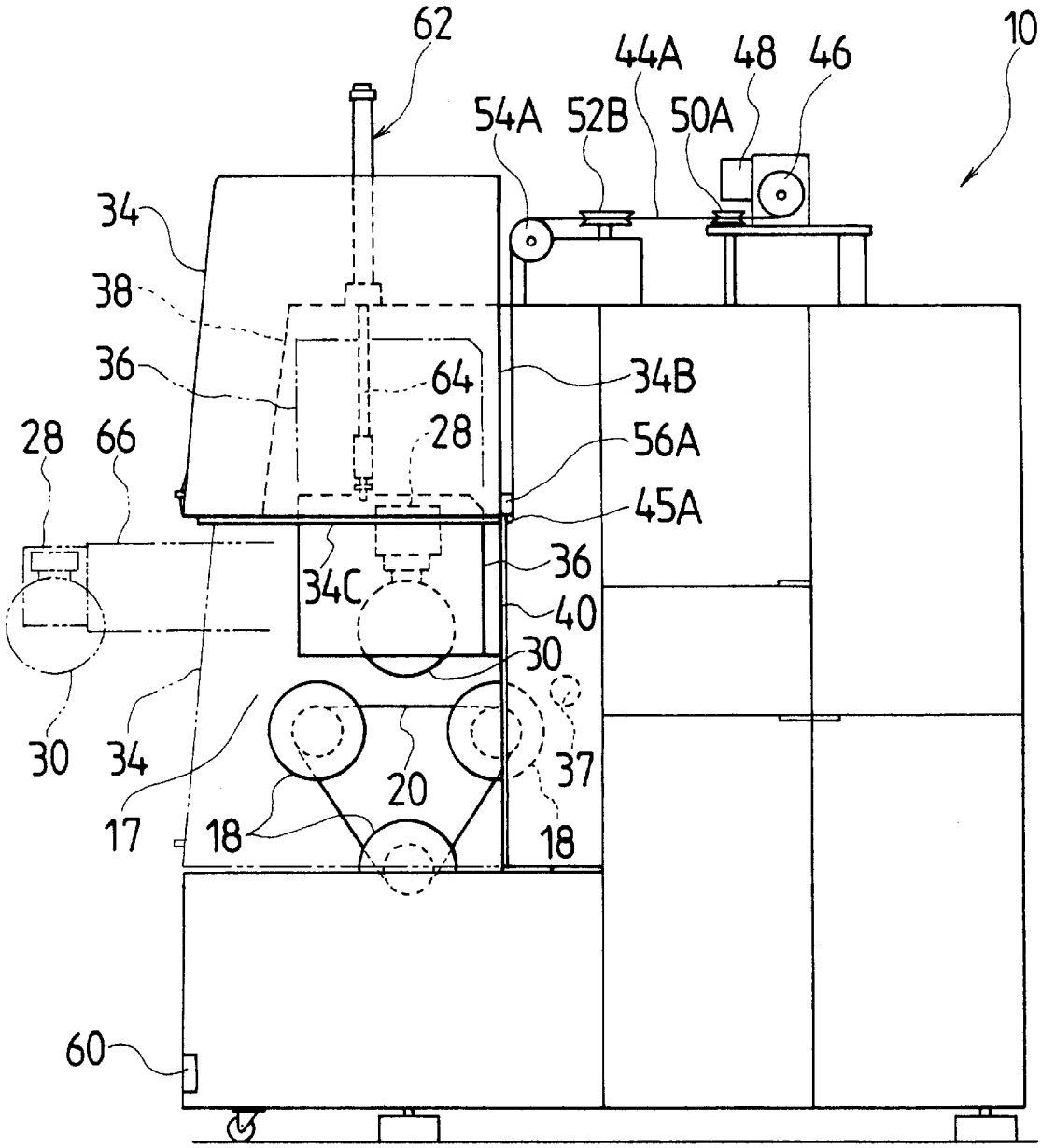
FIG. 3 is a side view of the wire saw in FIG. 1.

A guide 34B is formed at the right edge of the outside cover 34 in FIG. 3, and the guide 34B is connected to a rail 40, which is formed vertically in the body 11, so that the guide 34A can move up and down along the rail 40. Thus, the outside cover 34 can move up and down along the rail 40. The upward movement of the outside cover 34 exposes one part, in which the grooved rollers 18 are arranged, in the processing chamber 17. When the outside cover 34 moves down, the opening 34A at the top of the outside cover 34 is attached to the roof 38, and the lower side 34C of the outside cover 34 is adhered to the body 11. Thus, the processing chamber 17 is completely closed.

A winch 42 is arranged at the upper part of the body 11 to open and close the outside cover 34. As shown in FIG. 2, the winch 42 is comprised mainly of a reel 46, and a motor 48 that rotates the reel 46 forward and backward. Two wires 44A, 44B are wound around the reel 46, and the forward and backward rotations of the reel 46 wind and rewind the wires 44A, 44B.

As shown in FIG. 3, an end 45A of the wire 44A, which is wound around the reel 46, is rewound from the reel 46, and it is wound on two horizontal pulleys 50A, 52A. Then, the end 45A of the wire 44A is wound on a vertical pulley 54 to change its direction downward, and it is fixed at the lower corner of the outside cover 34 through a jig 56A. As shown in FIG. 2, the end of the wire 44B is rewound from the reel 46 and is wound on two horizontal pulleys 50B, 52B. Then, the end of the wire 44B is wound on a vertical pulley 54B to change its direction downward. The end of the wire 44B is fixed at the lower corner of the outside cover 34 through a jig (not illustrated).

An output shaft of the motor 48 connects to the reel 46 through a reducer 58. When the motor 48 rotates the reel 46 forward to wind the wires 44A, 44B around the reel 46, the outside cover 34 is pulled by the wires 44A, 44B to move up. This exposes one part of the processing chamber 17. When the motor 48 rotates the reel 46 backward to rewind the wires 44A, 44B from the reel 46, the outside cover 34 moves down due to its deadweight. Consequently, the outside cover 34 closes the processing chamber 17. A CPU (not illustrated) loaded in the wire saw 10 controls the motor 48. The CPU controls the motor 48 in accordance with commands which were received by a remote control receiving part 60 in FIG. 30. The remote control receiving part 60 is provided at the lower part of the front of the body 11.

The inner cover 36 is substantially U-shaped as indicated by dotted lines in FIG. 2. As shown in FIGS. 1 and 3, the inner cover 36 mainly covers the ingot 30, which is supported on the workpiece feed table 29. The inner cover 36 aims to prevent the slurry and cutting chips from scattering to the outside of the inner cover 36 while the wire saw 10 is slicing the ingot 30. As shown in FIG. 3, a vacuum duct 37 as an exhaust means is arranged in proximity to the inner cover 36. The vacuum duct 37 connects to a vacuum pump (not illustrated) which is arranged in the wire saw 10. The vacuum pump communicates a vent (not illustrated) which is exposed from the body 11 of the wire saw 10. Thus, when the vacuum pump is driven, the air in the processing chamber 17 is vacuumed through the vacuum duct 37 and is exhausted to the outside through the vent.

As shown in FIG. 3, a cylinder apparatus 62 for opening and closing the inner cover 36 is arranged on the roof 38. A rod 64 of the cylinder apparatus 62 extends downward through a hole, which is punched in the roof 38, and the top of the inner cover 36 is fixed to the bottom end of the rod 64. When the cylinder apparatus 62 contracts the rod 64, the inner cover 36 moves up to expose the ingot 30. When the cylinder apparatus 62 expands the rod 64, the inner cover 36 moves down to cover the ingot 30. As is the case with the motor 48, the CPU controls the cylinder apparatus 62. The CPU controls the cylinder apparatus 62 in accordance with commands, which are received by the remote control receiving part 60 in FIG. 3.

Figure 4:
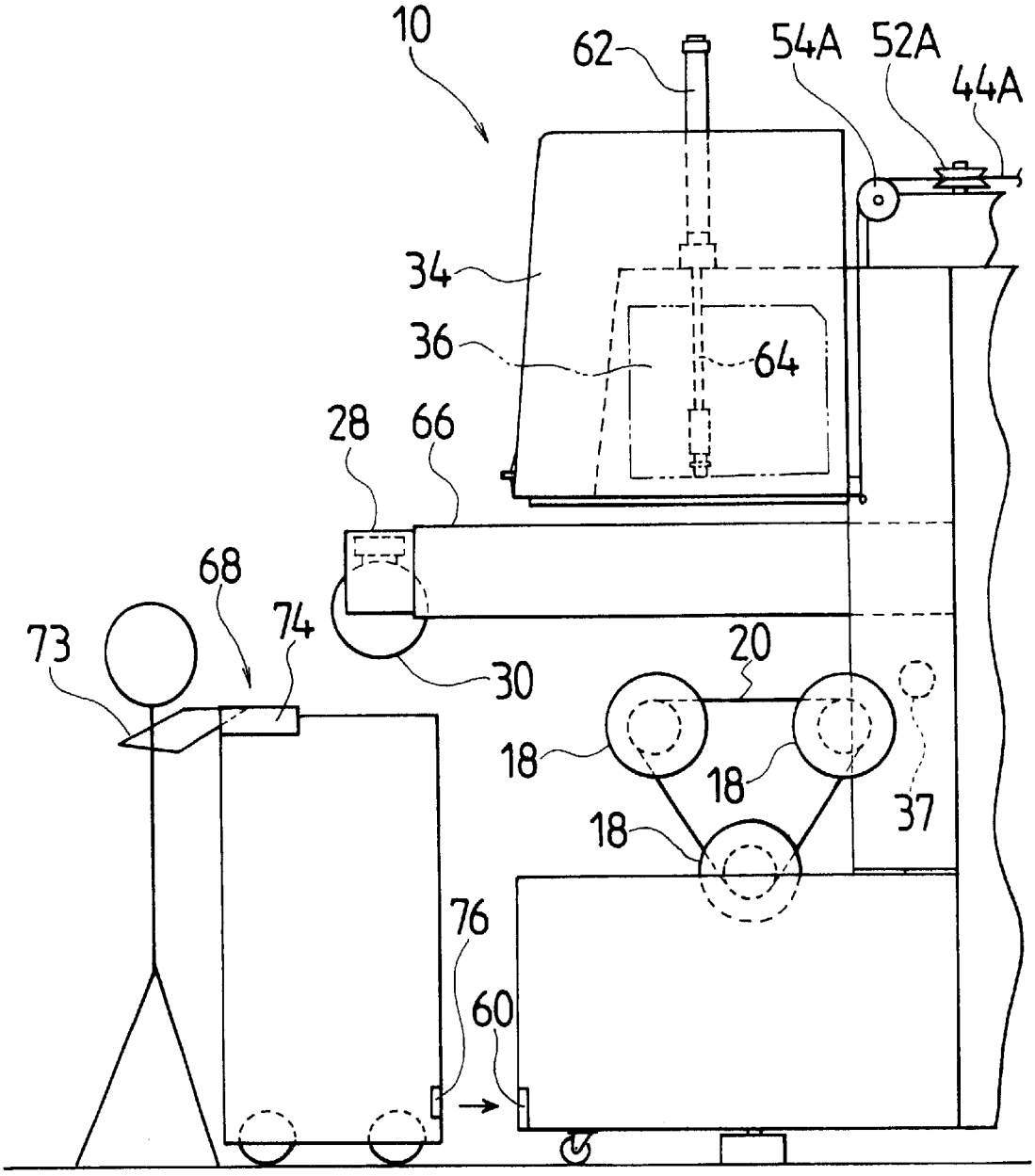
FIG. 4 is a view of assistance in explaining how an automatic guided vehicle exchanges ingots.

Incidentally, a pair of arms 66 supports a workpiece holder as shown in FIGS. 1–4. The arms 66 are arranged horizontally, and they are capable of expanding and contracting horizontally. When a driving apparatus (not illustrated) expands the arms 66, the ingot 30 is positioned outside the wire saw 10 as shown in FIG. 4. On the other hand, when the driving apparatus contracts the arms 66, the ingot 30 is positioned at the slicing position as shown in FIG. 1.

In the wire saw 10 which is constructed in the above-mentioned manner, the cover for covering the processing chamber 17 is composed of the outside cover 34 and the inner cover 36. Thus, it is possible to prevent the slurry and cutting chips from scattering to the outside while the wire saw 10 is slicing the ingot 30.

The wire saw 10 has the exhaust means for exhausting the air in the processing chamber 17. Driving the vacuum pump of the exhaust means exhausts the air and the misty slurry in the processing chamber 17 with the air Thus, if the vacuum pump is driven to exhaust the air including the slurry before the opening of the outside cover 34, the slurry and cutting chips are prevented from scattering to the outside.

Moreover, the pair of arms 66 is expanded to position the workpiece holder 28 outside the wire saw 10, and thus, the ingot 30 can easily be attached to and detached from the workpiece holder 28.

Figure 5:
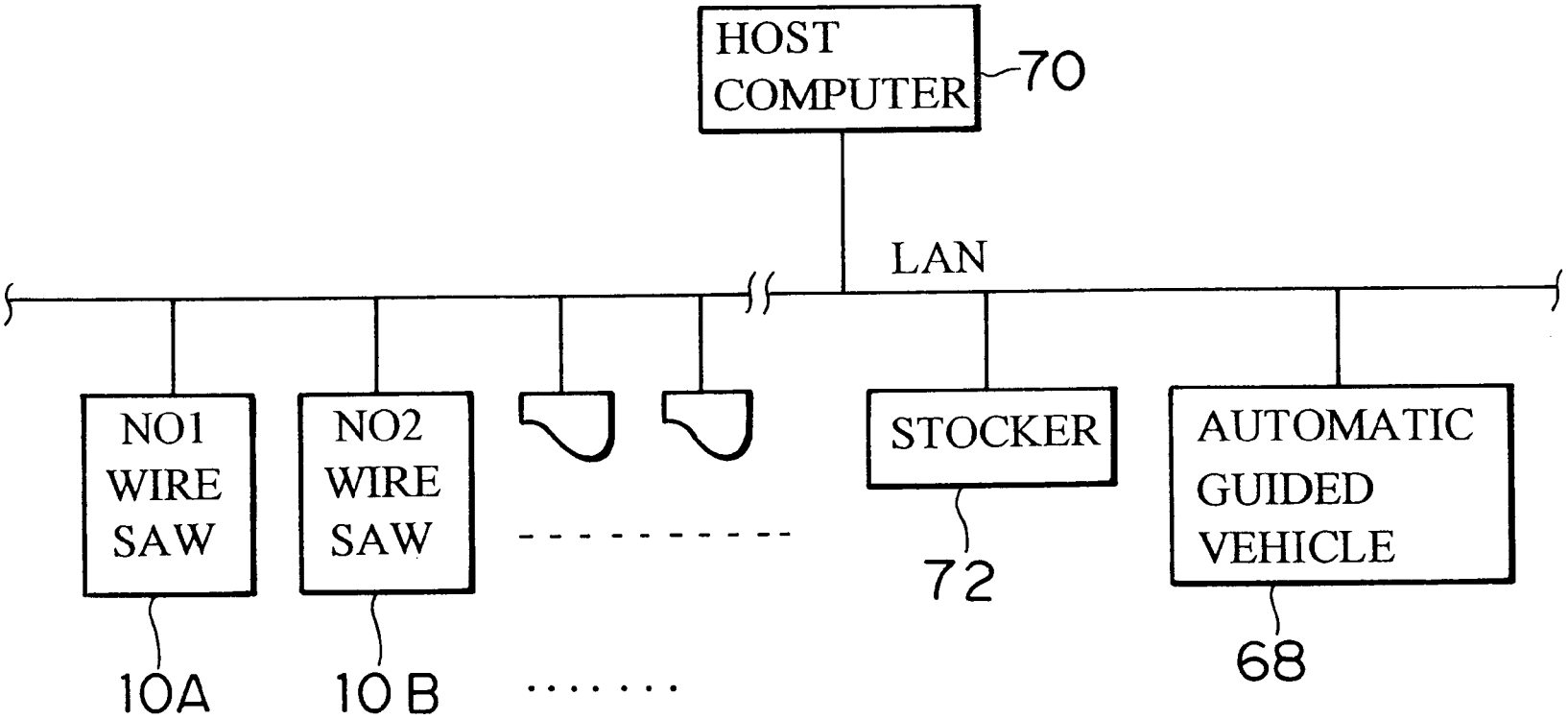
FIG. 5 is a block diagram illustrating control systems of the wire saw and the automatic guided vehicle.

FIG. 4 shows the state wherein the ingots 30 are exchanged by means of an automatic guided vehicle 68. A host computer 70 in FIG. 5 controls the automatic guided vehicle 68, which moves automatically from a stocker 72 to ingot exchanging positions of the wire saws (a No. 1 wire saw 10A, a No. 2 wire saw 10B . . . in FIG. 5) in accordance with commands from the host computer. As shown in FIG. 4, a control panel 74 is provided at the top of the automatic guided vehicle 68, and an operator 73 operates the control panel 74. A plurality of buttons for driving the winch 42, the cylinder apparatus 62, the driving apparatus for the arms 66 and the vacuum pump is arranged on the control panel 74. What is instructed by the buttons is transmitted as commands from a remote control transmitting part 76, which is provided at the lower part of the front of the automatic guided vehicle 68. The remote control receiving part 60 of the wire saw 10 receives the transmitted commands.

A description will now be given of a method of exchanging the ingots 30 by means of the automatic guide vehicle 68. First, the automatic guided vehicle 68 is moved to the stocker 72, and a predetermined ingot 30 is loaded on the automatic guided vehicle 68 from the stocker 72. Then, the automatic guided vehicle 68 is moved to the exchanging position of the wire saw 10, which is designated by the host computer 70, and the automatic guided vehicle 68 is stopped there. Next, the operator 73 presses a button on the control panel 74 to start exchanging the ingots 30. First, the operator 73 presses a vacuum pump drive button to drive the vacuum pump, which exhausts the air (including the misty slurry) in the processing chamber 17. Then, the operator 73 presses an outside cover opening button to open the outside cover 34, and presses an inner cover closing button to open the inner cover 36. The operator 73 presses an arm expanding button to expand the arms 66, so that the sliced ingot 30 can be positioned outside the wire saw 10. The sliced ingot 30 is detached from the workpiece holder 28, and is loaded on the automatic guided vehicle 68. The new ingot 30, which has not been sliced yet, is taken out from the automatic guided vehicle 68 and is attached to the workpiece holder 28. The exchange of the ingots 30 is completed.

On completion of the exchange, an arm contracting button is pressed to contract the arms 66, so that the new ingot 30 can be positioned at the slicing position of the wire saw 10. Then, an inner cover closing button is pressed to close the inner cover 36, and an outside cover closing button is pressed to close the outside cover 34. This completes the preparation for slicing the ingot 30. Then, the wire 14 starts running, and the workpiece feed table 29 feeds the ingot 30, so that the slicing of the ingot 30 can be started.

If the automatic guided vehicle 68, which is capable of running the drive mechanism of the wire saw 10 to exchange the ingots 30, is installed in a plant where the wire saw 10 is placed, it is possible to reduce the number of people who exchange the ingots 30 and achieve the full automation.

As set forth hereinabove, according to the wire saw of the present invention, the cover for covering the processing chamber is composed of the outside cover and the inner cover to prevent the slurry and cutting chips from scattering to the outside while the wire saw is slicing the workpiece.

Moreover, there is provided the exhaust means for exhausting the air in the processing chamber. The exhaust means is driven before the outside cover is opened, and the misty slurry as well as the air in the processing chamber is exhausted to the outside. Then, the outside cover and the inner cover are opened to attach and detach the workpiece. Consequently, the slurry and cutting chips do not scatter to the outside.

Furthermore, there is provided the moving means which reciprocates the workpiece holder between the processing chamber and the outside of the workpiece holder. The moving means is driven to position the workpiece holder at the outside of the wire saw. It is therefore easy to attach and detach the workpieces with respect to the workpiece holder.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wire saw which winds a wire on a plurality of grooved rollers to form wire rows, runs said wire rows, and presses a workpiece against said running wire rows, thus slicing said workpiece into a number of wafers, said wire saw comprising:

a cover for covering a processing chamber, in which a workpiece feed table and said plurality of grooved rollers are arranged, said cover being composed of an outside cover and an inside cover;

opening and closing means for opening and closing said outside cover and said inner cover;

wherein said inner cover covers an ingot held on said workpiece feed table and is mounted for vertical displacement by a first drive;

wherein said outer cover covers said processing chamber and is mounted for vertical displacement by a second drive; and wherein a control means for independently controlling each of said first and second drives is provided.

2. The wire saw as defined in claim 1, further comprising exhaust means for exhausting air in the processing chamber out from said wire saw.

3. The wire saw as defined in claim 1, further comprising a workpiece holder provided with moving means for reciprocating said workpiece into and out of said processing chamber and said wire saw.

4. The wire saw as defined in claim 1, wherein said outer cover covers said inner cover in a lowered position thereof.

5. A wire saw which winds a wire on a plurality of grooved rollers to form wire rows, runs said wire rows, and presses a workpiece on a workpiece feed table against said running wire rows, thus slicing said workpiece into a number of wafers, said wire saw comprising:

an inner cover covers an ingot held on said workpiece feed table;

a first drive means which displaces said inner cover;

an outer cover which covers the inner cover and said plurality of grooved rollers;

a second drive means which displaces the outer cover; and a control means for independently controlling the first and second drive means.

6. The wire saw as defined in claim 5, wherein said outer cover is mounted for sliding displacement.

* * * * *